US010898774B1

(12) United States Patent
Elias et al.

(10) Patent No.: US 10,898,774 B1
(45) Date of Patent: Jan. 26, 2021

(54) HOCKEY TARGET AND PUCK RETURN SYSTEM AND METHOD OF USE

(71) Applicants: Lee M. Elias, Havertown, PA (US); Matthew Eastman, Havertown, PA (US); Kenneth David Shaw, Victoria (CA); Jordie Oberg, Victoria (CA)

(72) Inventors: Lee M. Elias, Havertown, PA (US); Matthew Eastman, Havertown, PA (US); Kenneth David Shaw, Victoria (CA); Jordie Oberg, Victoria (CA)

( * ) Notice: Subject to any disclaimer, the term of this patent is extended or adjusted under 35 U.S.C. 154(b) by 0 days.

(21) Appl. No.: 16/519,625

(22) Filed: Jul. 23, 2019

Related U.S. Application Data

(60) Provisional application No. 62/703,154, filed on Jul. 25, 2018.

(51) Int. Cl.
*A63B 63/00* (2006.01)
*A63B 69/00* (2006.01)

(52) U.S. Cl.
CPC ..... *A63B 63/004* (2013.01); *A63B 69/0024* (2013.01); *A63B 2063/001* (2013.01)

(58) Field of Classification Search
CPC ..... A63B 63/004; A63B 69/0024; A63B 2063/001
See application file for complete search history.

(56) References Cited

U.S. PATENT DOCUMENTS

2012/0283046 A1* 11/2012 Yannanashi ..... A63B 69/0097 473/432
2019/0083870 A1* 3/2019 Kapsalis ..... A63B 69/002

* cited by examiner

*Primary Examiner* — Jeffrey S Vanderveen
(74) *Attorney, Agent, or Firm* — Richard Eldredge; Eldredge Law Firm

(57) ABSTRACT

A hockey puck return target system includes a body extending from a top to a bottom and from a first side to a second side, the body having a curved positioned near the bottom to facilitate puck return; a cover positioned substantially in front of the body, the cover having openings extending through a thickness of the cover; the openings are configured to receive the hockey puck and facilitate entry of the hockey puck into the body; one or more straps attached to the body and to secure the body to a hockey goal.

4 Claims, 3 Drawing Sheets

HOCKEY TARGET AND PUCK RETURN SYSTEM AND METHOD OF USE

BACKGROUND

1. Field of the Invention

The present invention relates generally to hockey game systems, and more specifically, to a hockey target and puck return system and method for receiving and returning one or more hockey pucks to a player.

2. Description of Related Art

Hockey game systems are well known in the art and are effective means of recreation and entertainment. For example, hockey games are presented for entertainment to an audience, wherein the players of the hockey game typically spend hours every week practicing the game. During practice, it is common for the players to practice shooting a puck towards a goal. For a more real life experience, a goalie may be positioned within the goal to block the pucks from entering therein. This can become tiring and even dangerous for the goalie. In addition, hockey pucks are not commonly collected in a convenient and efficient manner.

Accordingly, although great strides have been made in the area of hockey game systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
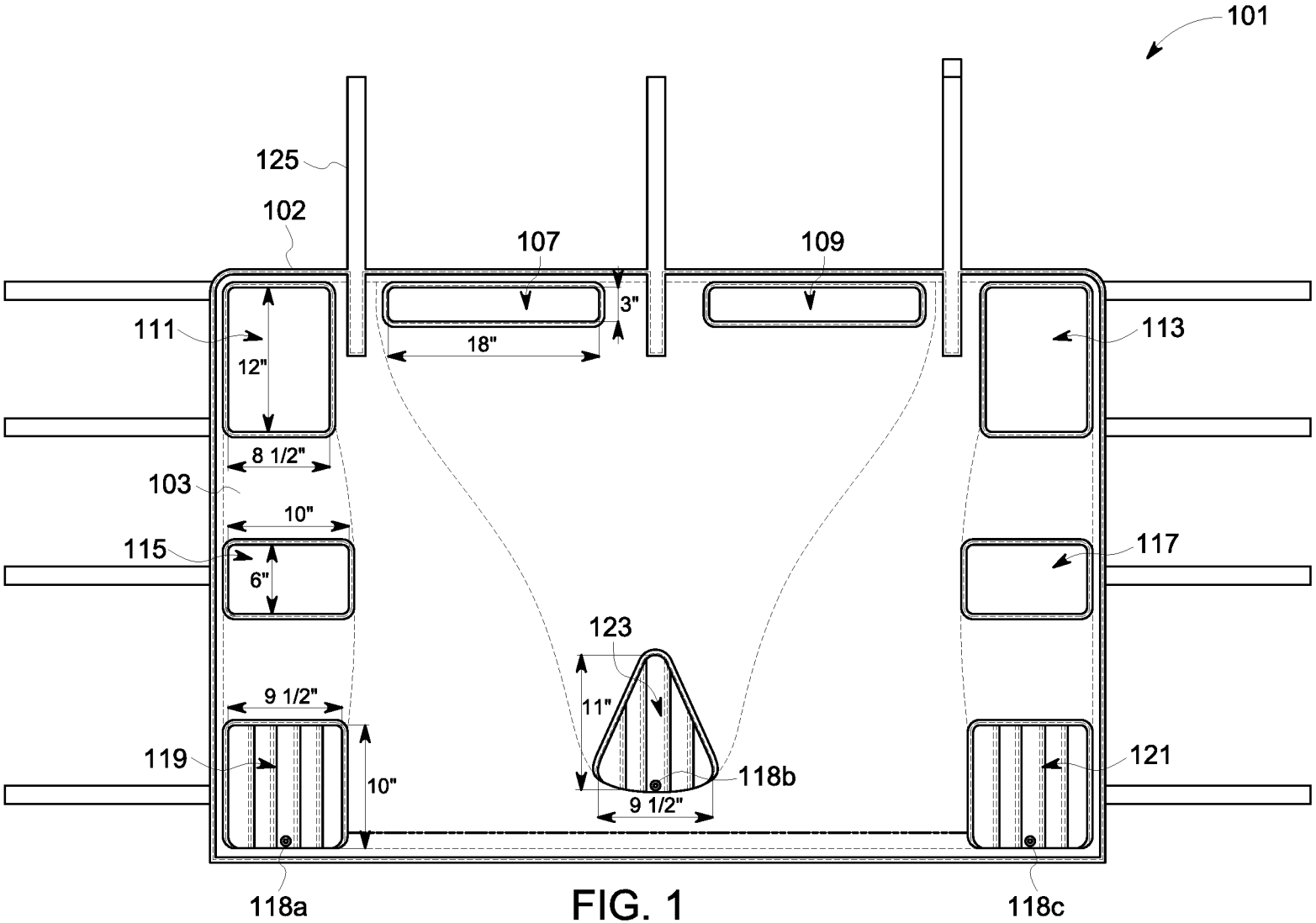
FIG. 1 is a front view of a hockey target and puck return system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional hockey game systems. Specifically, the present invention provides for a hockey target system that eliminates the need for a goalie during practice and provides for a puck collection and return feature that improves efficiency of practice. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front view of a hockey target and puck return system 101 in accordance with a preferred embodiment of the present application. It will be appreciated that system 101 overcomes one or more of the above-listed problems commonly associated with conventional hockey game systems.

In the contemplated embodiment, system 101 includes a body 102 extending from a top end to a bottom end and from a first side to a second side, the body 102 can be composed of various materials, including fabrics, thereby providing for flexibility. In the preferred embodiment, the body 102 is positioned behind a cover 103, the cover again being composed of various materials, including a fabric. The system includes one or more straps 125, which can be adjustable, and configured to secure the system to a hockey goal. As shown, the cover 103 includes a plurality of openings 107, 109, 111, 113, 115, 119, 121, 123, the openings extending through a thickness of the cover, and thereby providing access to the body through the opening. During use, the openings are configured to be shot at by the players and receive the pucks therethrough.

It should be appreciated that the openings can vary in configuration and size based on aesthetical, manufacturing, or functional considerations. However, the sizes of one embodiment are shown for example, as shown, the openings can include: a top left corner opening 111 being 12 inches in height and 8½ inches in width; a top right corner opening 113 being 12 inches in height and 8½ inches in width; a top left horizontal opening 107 being 3 inches in height and 18 inches in width; a top right horizontal opening 109 being 3 inches in height and 18 inches in width; a middle left side opening 115 being 6 inches in height and 10 inches in width; a middle right side opening 117 being 6 inches in height and 10 inches in width; a bottom left side opening 119 being 10 inches in height and 9½ inches in width; a bottom right side opening 121 being 10 inches in height and 9½ inches in width; and a center triangular opening 123 having a maximum width of 9½ inches and a height of 11 inches.

In the bottom pockets, it is contemplated that grommets 118*a-c* can be positioned within the body to create darts, thereby creating a curved shape, as will be discussed below.

It should be appreciated that one of the unique features believed characteristic of the present application is the configuration of the cover with the plurality of openings positioned over the body, wherein the plurality of openings are configured to receive one or more pucks into the body for return to the player.

Figure 2:
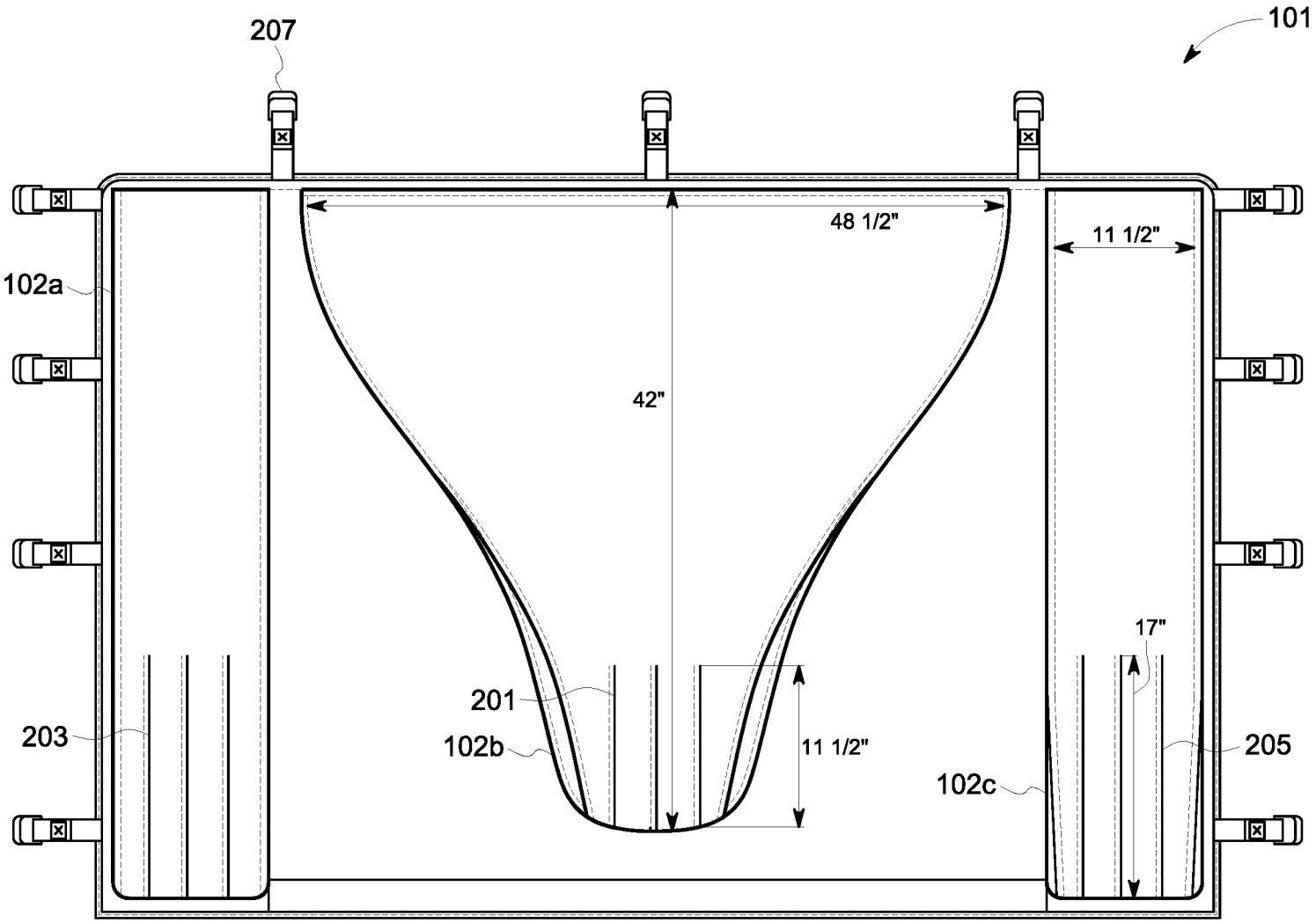
FIG. 2 is a back view of the the system of FIG. 1.

In FIG. 2, a back view of system 101 is shown. As shown, the body 102 can be separated into a left side back pocket 102*a*, a right side back pocket 102*c*, and a center back pocket 102*c*. It should be appreciated that in the preferred embodiment, the left side back pocket is in communication with the top left corner opening, the left side opening, and the bottom left side opening. The right side back pocket is in communication with the top right corner opening, the right side opening, and the bottom right side opening. The center back pocket is in communication with the top left horizontal opening, the top right horizontal opening, and the center triangular opening.

Figure 3:
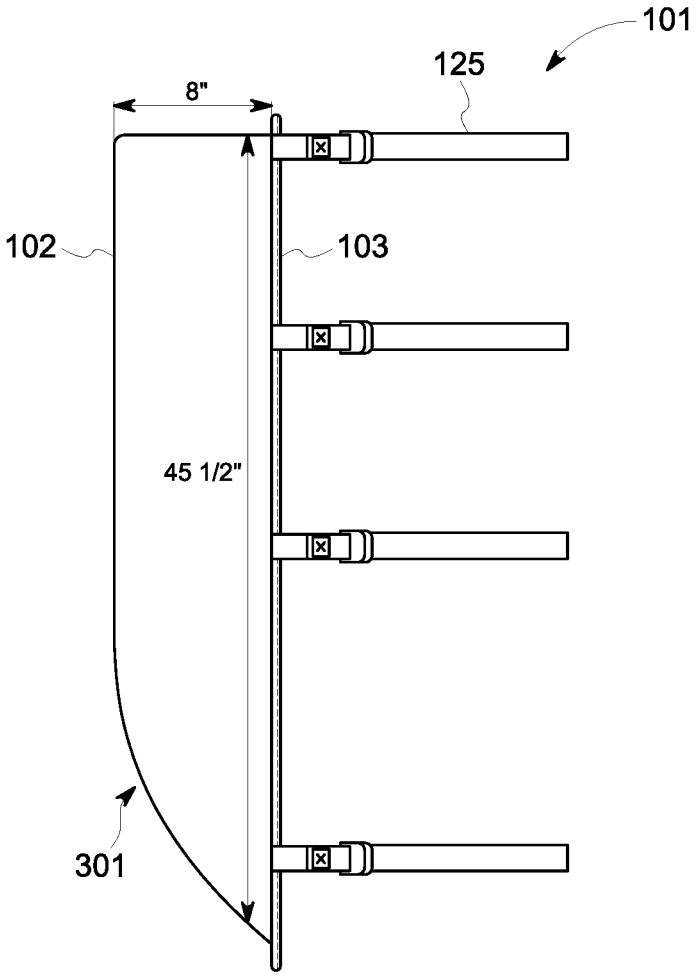
FIG. 3 is a side view of the system of FIG. 1.

As further shown, the back pockets include darts 201, 203, 205. These darts aid in creating a curved portion 301 (as shown in FIG. 3) at the bottom of the pockets, thereby being configured to funnel the pucks received from the openings to the bottom and out through the bottom openings.

It should further be appreciated that one or more rings 207 can be attached to one or more of the straps of the system, thereby allowing for adjustability and securement of the straps to the goal.

Figure 4:
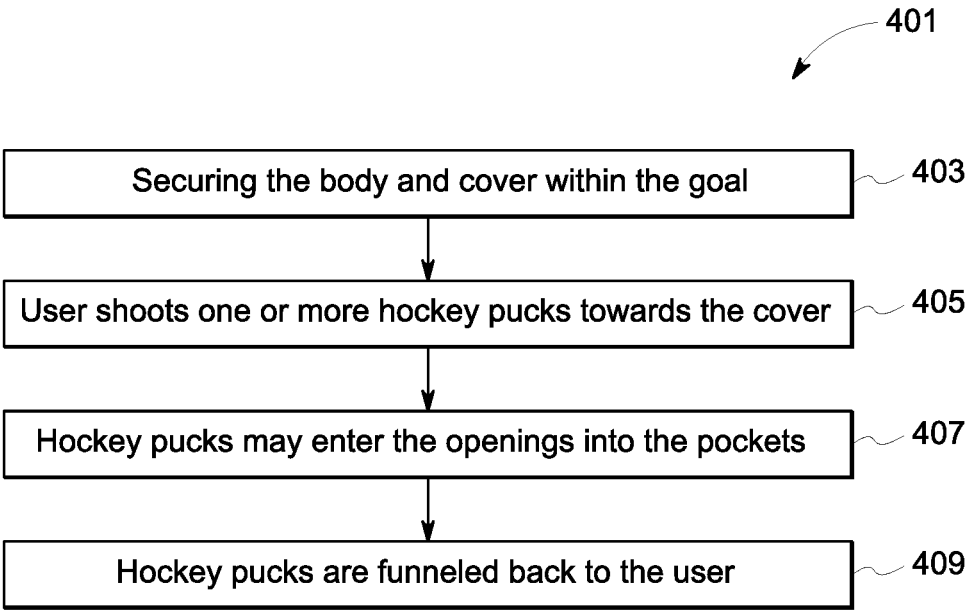
FIG. 4 is a flowchart of the method of use of the system of FIG. 1.

In FIG. 4, a flowchart 401 depicts the method of use of system 101. During use, the body and cover are secured within a hockey goal, as shown with box 403. The user can proceed to shoot one or more hockey pucks towards the cover, aiming at the openings as desired, as shown with box 405. The hockey pucks will either be repelled from the cover, or alternatively, enter into the pockets through the openings and funneled back to the user through the bottom openings, as shown with boxes 407, 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A hockey puck return target system, comprising:

a body extending from a top to a bottom and from a first side to a second side, the body having a curved portion near the bottom to facilitate puck return, the body is composed of a fabric and a plurality of darts sewn into the fabric to create the curve positioned near the bottom of the body;

a cover positioned substantially in front of the body, the cover having:

a plurality of openings extending through a thickness of the cover;

wherein the plurality of openings are configured to receive the hockey puck and facilitate entry of the hockey puck into the body;

one or more straps attached to the body and configured to secure the body to a hockey goal.

2. The system of claim 1, wherein the plurality of openings include:

a top left corner opening being 12 inches in height and 8½ inches in width; a top right corner opening being 12 inches in height and 8½ inches in width;

a top left horizontal opening being 3 inches in height and 18 inches in width;

a top right horizontal opening being 3 inches in height and 18 inches in width;

a middle left side opening being 6 inches in height and 10 inches in width; a middle right side opening being 6 inches in height and 10 inches in width;

a bottom left side opening being 10 inches in height and 9½ inches in width;

a bottom right side opening being 10 inches in height and 9½ inches in width;

and a center triangular opening having a maximum width of 9½ inches and a height of 11 inches.

3. The system of claim 2, wherein the body further comprises:

a center back pocket that is in communication with the top left horizontal opening, the top right horizontal opening, and the center triangular opening, the center back pocket configured to receive one or more hockey pucks that enter through the top left horizontal opening, the top right horizontal opening, and the center triangular opening;

a left side back pocket in communication with the top left corner opening, the left side opening, and the bottom left side opening; and a right side back pocket in communication with the top right corner opening, the right side opening, and the bottom right side opening.

4. A method of returning a hockey puck from a hockey goal, the method comprising: providing the system of claim 1;

securing the system of claim 1 to the hockey goal such that the body is positioned within the hockey goal via the one or more straps; and shooting one or more hockey pucks at the cover and the plurality of openings;

wherein the one or more hockey pucks are funneled out of the body and back to the user.

* * * * *